US009854904B2

(12) United States Patent
Getz

(10) Patent No.: US 9,854,904 B2
(45) Date of Patent: Jan. 2, 2018

(54) PORTABLE WORKSTATION ASSEMBLY

(71) Applicant: Lori Getz, Agoura Hills, CA (US)

(72) Inventor: Lori Getz, Agoura Hills, CA (US)

( * ) Notice: Subject to any disclaimer, the term of this patent is extended or adjusted under 35 U.S.C. 154(b) by 0 days.

(21) Appl. No.: 15/131,189

(22) Filed: Apr. 18, 2016

(65) Prior Publication Data

US 2017/0295924 A1 Oct. 19, 2017

(51) Int. Cl.

| | |
|---|---|
| ***A47B 57/00*** | (2006.01) |
| ***A47B 23/04*** | (2006.01) |
| ***A47B 23/00*** | (2006.01) |
| ***A47B 21/03*** | (2006.01) |
| *A47B 21/02* | (2006.01) |
| *A47B 21/04* | (2006.01) |
| *A47B 21/007* | (2006.01) |

(52) U.S. Cl.

CPC ..... *A47B 23/04* (2013.01); *A47B 21/03* (2013.01); *A47B 23/001* (2013.01); *A47B 21/0073* (2013.01); *A47B 21/02* (2013.01); *A47B 21/0314* (2013.01); *A47B 21/04* (2013.01); *A47B 2023/049* (2013.01)

(58) Field of Classification Search

CPC ..... A47B 21/02; A47B 21/03; A47B 21/04; A47B 21/0073; A47B 21/0314; A47B 21/0371; A47B 23/02; A47B 23/025; A47B 23/04; A47B 9/18; A47B 2009/185; A47B 2021/0307; A47B 2021/0392; A47B 2023/047; A47B 2023/049

See application file for complete search history.

(56) References Cited

U.S. PATENT DOCUMENTS

| | | | | | |
|---|---|---|---|---|---|
| 3,833,258 | A * | 9/1974 | Schneider | A47C 1/16 | 297/252 |
| 3,904,003 | A | 9/1975 | Margerum | | |
| 3,923,356 | A | 12/1975 | Washbume | | |
| 4,316,082 | A * | 2/1982 | Fritz | A47B 21/0314 | 108/32 |
| D273,537 | S | 4/1984 | Gerch | | |
| 4,595,086 | A | 6/1986 | Simpson | | |
| 4,717,112 | A * | 1/1988 | Pirkle | A47B 21/02 | 108/140 |
| 4,856,627 | A | 8/1989 | Polatov | | |
| 5,062,609 | A * | 11/1991 | Hames | A47B 21/0314 | 248/176.1 |
| 5,078,460 | A | 1/1992 | Holsinger | | |
| 5,213,401 | A * | 5/1993 | Hatcher | A47B 21/0314 | 312/208.1 |
| 5,385,399 | A * | 1/1995 | Weidner | A47B 63/00 | 312/190 |
| 5,452,876 | A * | 9/1995 | Hatcher | A47B 21/0314 | 248/441.1 |

(Continued)

FOREIGN PATENT DOCUMENTS

| | | |
|---|---|---|
| WO | WO8300120 | 1/1983 |

*Primary Examiner* — Daniel J Troy
*Assistant Examiner* — Andres F Gallego

(57) ABSTRACT

A portable workstation assembly for coupling a computer desk to a table top includes a table unit that may be removably coupled to a horizontal support surface. Thus, the table unit may support an object. A tray unit is slidably coupled to the table unit and the tray unit may support an object. The tray unit is positionable between a stored position and a deployed position with respect to the table unit.

5 Claims, 6 Drawing Sheets

(56) References Cited

U.S. PATENT DOCUMENTS

| | | | | |
|---|---|---|---|---|
| 5,484,124 | A * | 1/1996 | Billings | A47B 21/0371 248/118 |
| 5,833,200 | A * | 11/1998 | Patterson | A47B 23/002 108/34 |
| 6,010,262 | A * | 1/2000 | Linyear | A47B 21/0314 248/441.1 |
| 6,637,841 | B1 * | 10/2003 | Dumornay | G11B 33/0444 312/9.48 |
| 8,826,831 | B2 * | 9/2014 | Hazzard | A47B 21/02 108/50.01 |
| 9,504,316 | B1 * | 11/2016 | Streicher | A47B 21/02 |
| 9,554,644 | B2 * | 1/2017 | Flaherty | A47B 9/18 |
| 2002/0104948 | A1 * | 8/2002 | Hicks | A47B 21/0314 248/346.01 |
| 2005/0211863 | A1 * | 9/2005 | Masi | A47B 21/0314 248/442.2 |
| 2014/0311388 | A1 * | 10/2014 | Korpi | A47B 23/001 108/6 |
| 2015/0114271 | A1 * | 4/2015 | Torrachi | F16B 2/065 108/97 |

* cited by examiner

PORTABLE WORKSTATION ASSEMBLY

BACKGROUND OF THE DISCLOSURE

Field of the Disclosure

The disclosure relates to workstation devices and more particularly pertains to a new workstation device for coupling a computer desk to a table top.

SUMMARY OF THE DISCLOSURE

An embodiment of the disclosure meets the needs presented above by generally comprising a table unit that may be removably coupled to a horizontal support surface. Thus, the table unit may support an object. A tray unit is slidably coupled to the table unit and the tray unit may support an object. The tray unit is positionable between a stored position and a deployed position with respect to the table unit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
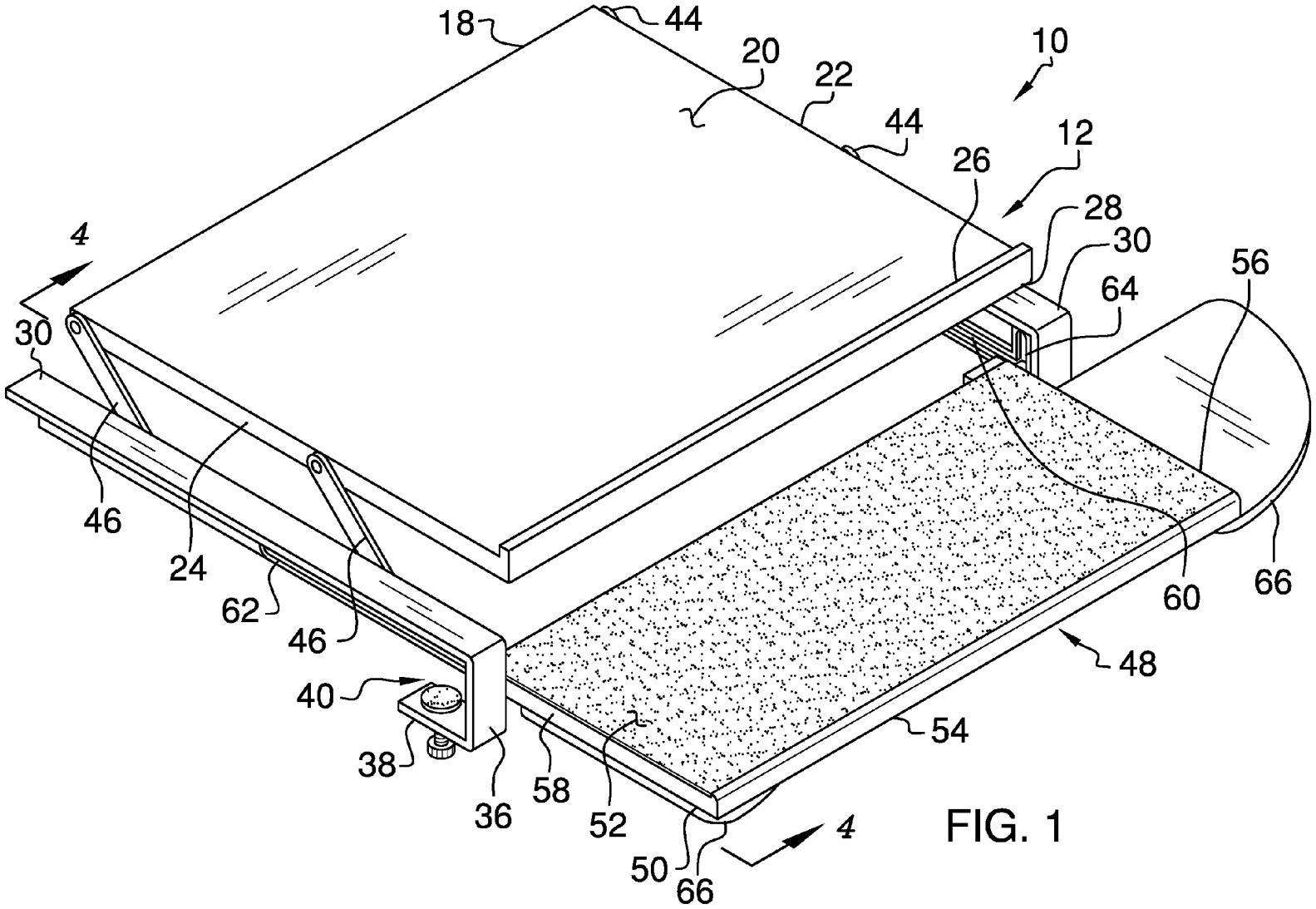
FIG. 1 is a perspective view of a portable workstation assembly according to an embodiment of the disclosure.
Figure 2:
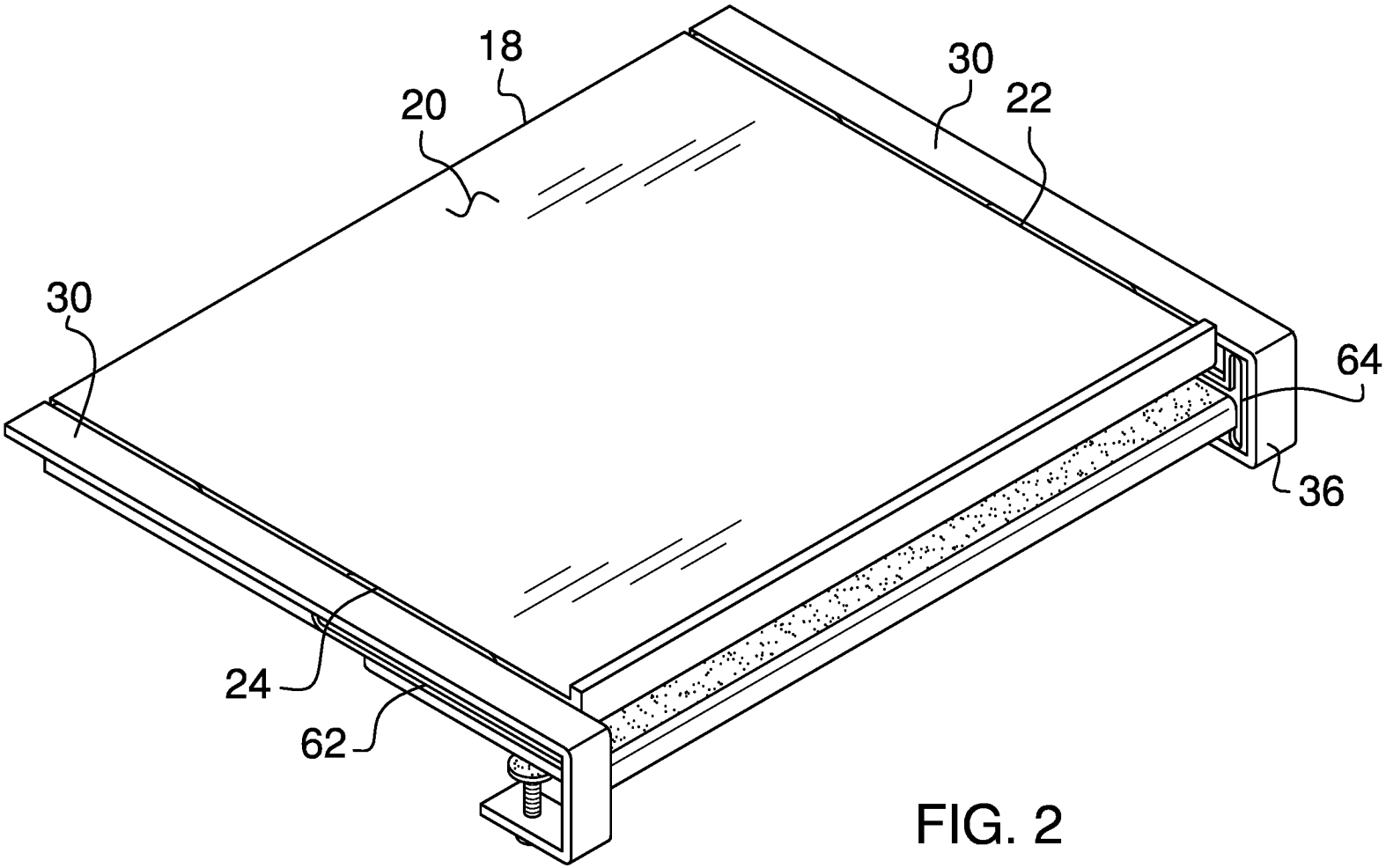
FIG. 2 is a top perspective view of an embodiment of the disclosure.
Figure 3:
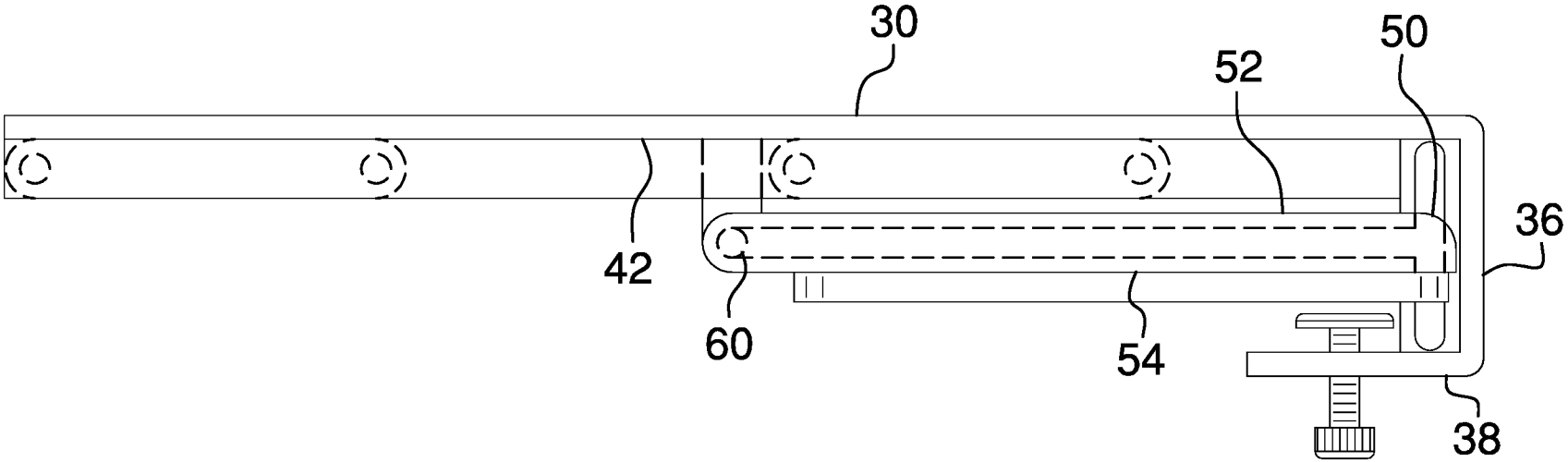
FIG. 3 is a right side view of an embodiment of the disclosure.
Figure 4:
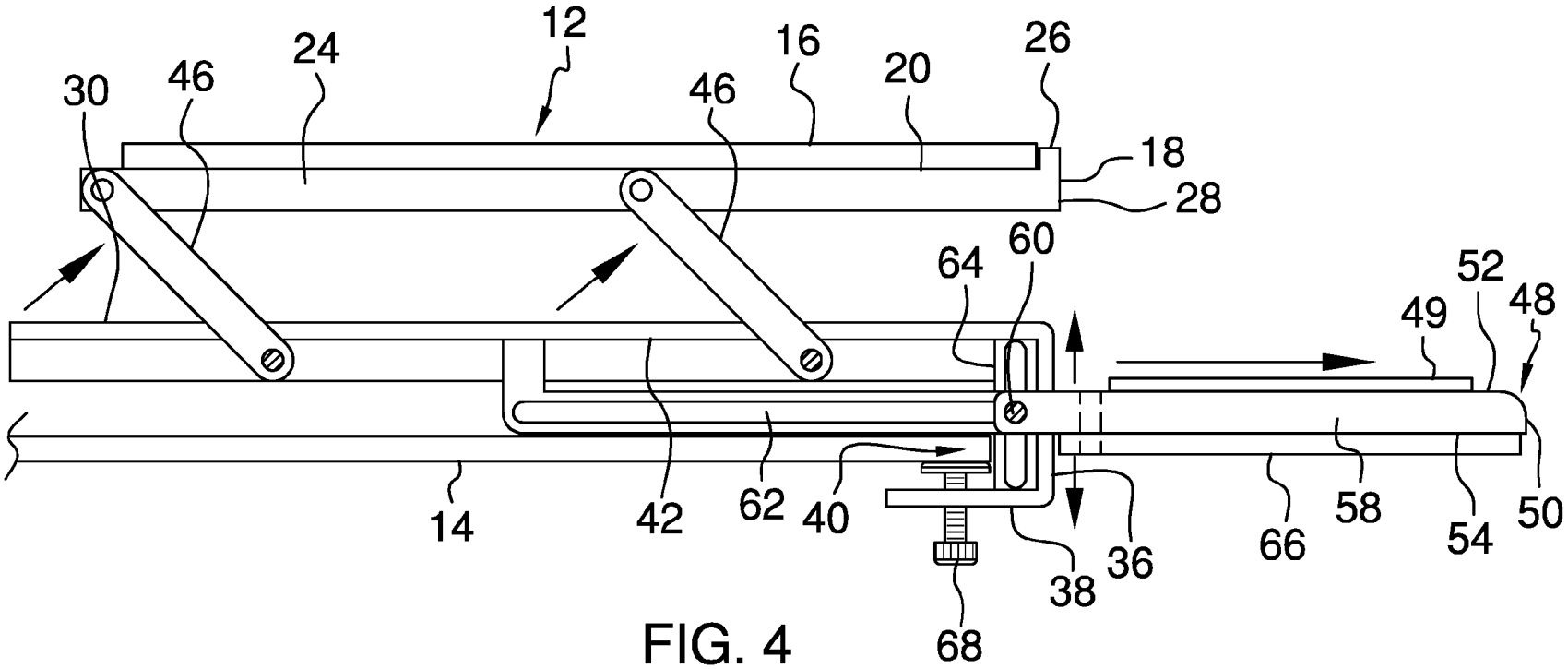
FIG. 4 is a cross sectional view taken along line 4-4 of FIG. 1 of an embodiment of the disclosure.
Figure 5:
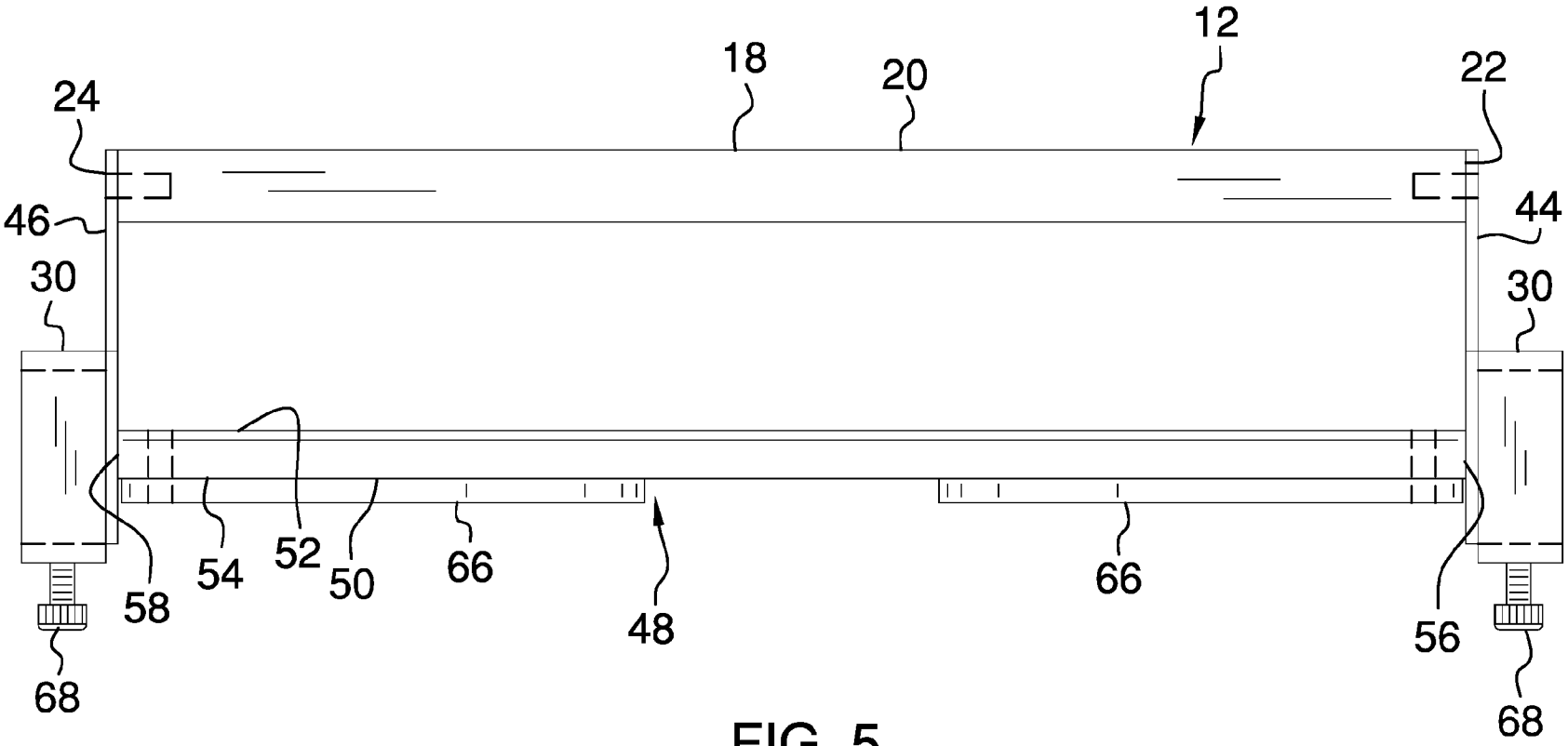
FIG. 5 is a front view of an embodiment of the disclosure.
Figure 6:
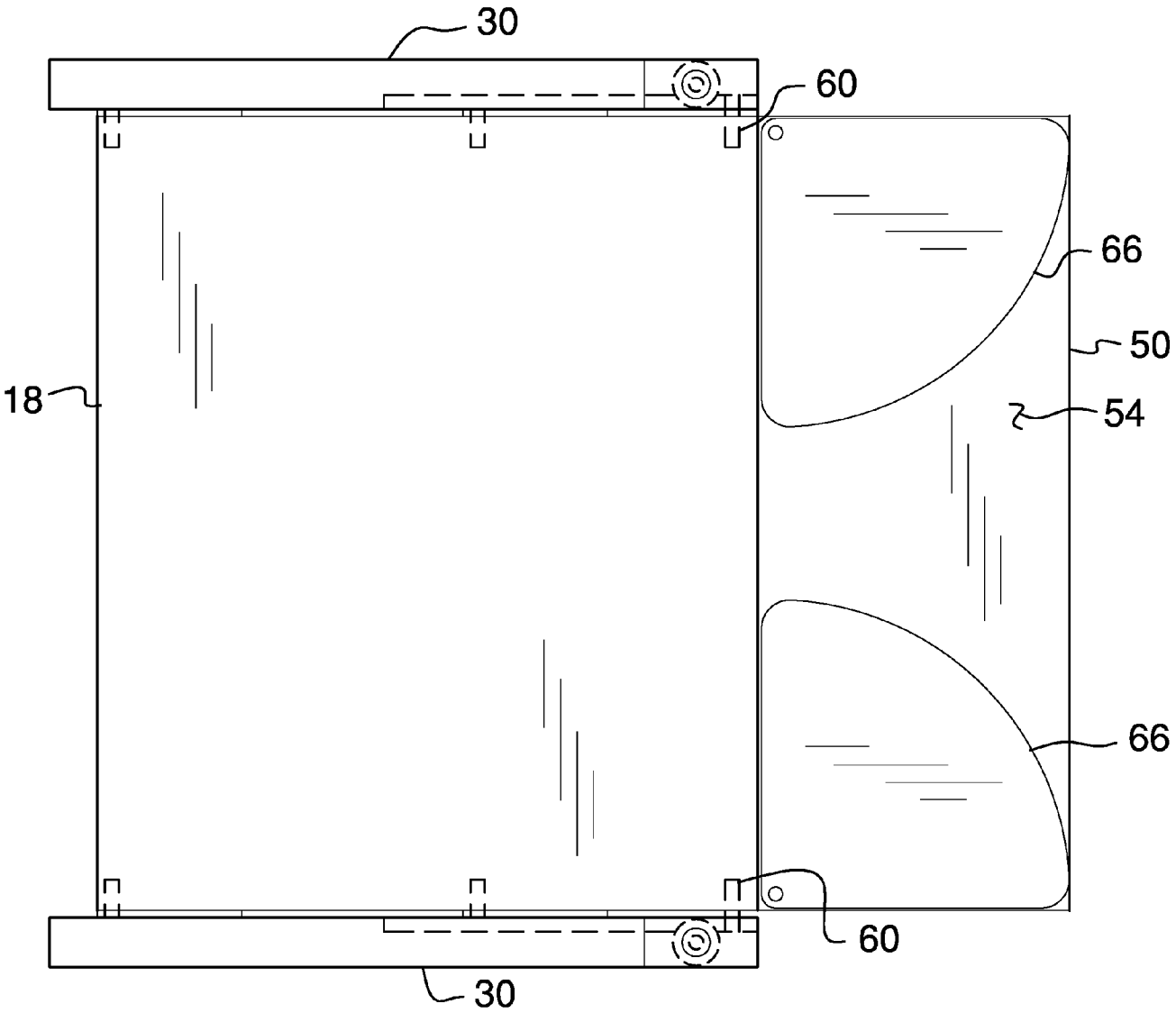
FIG. 6 is a top view of an embodiment of the disclosure.

With reference now to the drawings, and in particular to FIGS. 1 through 6 thereof, a new workstation device embodying the principles and concepts of an embodiment of the disclosure and generally designated by the reference numeral 10 will be described.

As best illustrated in FIGS. 1 through 6, the portable workstation assembly 10 generally comprises a table unit 12 that may be removably coupled to a horizontal support surface 14. Thus, the table unit 12 may support an object 16. The horizontal support surface 14 may be a table top or the like. The object 16 may be a personal computer or the like.

The table unit 12 comprises a platform 18 that has a top surface 20, a first lateral edge 22 and a second lateral edge 24. The top surface 20 may have the object 16 positioned thereon. The platform 18 may include a lip 26 extending upwardly from a front edge 28 of the platform 18. The lip 26 may inhibit the object 16 from sliding off of the platform 18.

A pair of rails 30 is provided and each of the rails 30 includes a leg 36 and a foot 38. The leg 36 corresponding to each of the rails 30 extends downwardly from the corresponding rail 30. The foot 38 is spaced from and is substantially coextensive with the corresponding rail 30. Thus, a table space 40 is defined between the foot 38 and the rail 30. The table space 40 corresponding to each of the rails 30 may insertably receive the horizontal support surface 14. The rails 30 are spaced apart from each other and each of the rails 30 has a bottom surface 42.

A pair of first arms 44 is provided. Each of the first arms 44 is hingedly coupled between the first lateral edge 22 of the platform 18 and an associated one of the rails 30. The first arms 44 are spaced apart from each other. A pair of second arms 46 is provided. Each of the second arms 46 is hingedly coupled between the second lateral edge 24 of the platform 18 and an associated one of the rails 30. The second arms 46 are spaced apart from each other.

The platform 18 is positioned in a stored position. Thus, the platform 18 positioned between the rails 30. The platform 18 is positioned in a deployed position. Thus, the platform 18 is spaced upwardly from the rails 30.

A tray unit 48 is provided. The tray unit 48 is slidably coupled to the table unit 12 and the tray unit 48 may support an object 49. The object 49 corresponding to the tray unit 48 may be a keyboard or the like. The tray unit 48 is positionable between a stored position and a deployed position with respect to the table unit 12.

The tray unit 48 comprises a first panel 50 that has a top surface 52, a bottom surface 54, a first sidelong edge 56 and a second sidelong edge 58. The top surface 52 may have the object 49 positioned thereon. The top surface 52 may be textured thereby enhancing frictional engagement between the object 49 and the top surface 52. A pair of pins 60 is provided. Each of the pins 60 is coupled to and extends outwardly from an associated one of the first sidelong edge 56 and the second sidelong edge 58.

A pair of first tracks 62 is provided and each of the first tracks 62 is coupled to an associated one of the rails 30. Each of the first tracks 62 is spaced from the bottom surface 42 of the associated rail 30. Each of the first tracks 62 extends away from the leg 36 of the associated rail 30. Each of the pins 60 slidably engages an associated one of the first tracks 62 such that the first panel 50 is slidably coupled to the rails 30. The first panel 50 is positioned beneath the platform 18 when the tray unit 48 is positioned in the stored position. The first panel 50 extends forwardly from the leg 36 corresponding to each of the rails 30 when the tray unit 48 is positioned in the deployed position.

A pair of second tracks 64 is provided. Each of the second tracks 64 is coupled to an associated one of the rails 30. Each of the second tracks 64 extends along the leg 36 of the associated rail 30. Thus, each of the second tracks 64 intersects an associated one of the first tracks 62. Each of the second tracks 64 is oriented transverse with respect to the associated first track 62. Each of the pins 60 selectively slides upwardly and downwardly along an associated one of the second tracks 64 when the tray unit 48 is positioned in the deployed position.

A pair of second panels 66 is provided and each of the second panels 66 is hingedly coupled to the first panel 50. Each of the second panels 66 is aligned with an associated one of the first sidelong edge 56 and the second sidelong edge 58. Each of the second panels 66 is positioned on the bottom surface 54 of the first panel 50. Each of the second panels 66 is positioned in a stored position. Thus, each second panel 66 is positioned beneath the first panel 50. Each of the second panels 66 is positioned in a deployed position. Thus, each of the second panels 66 extends outwardly from the associated first sidelong edge 56 and the associated second sidelong edge 58.

A pair of thumb screws 68 is provided. Each of the thumb screws 68 extends upwardly through the foot 38 corresponding to an associated one of the rails 30. Thus, each of the thumb screws 68 may be manipulated. Each of the thumb screws 68 may compress the horizontal support surface 14 between the first tracks 62 and the thumb screws 68. Thus, the table unit 12 is retained on the horizontal support surface 14.

In use, the table unit 12 is manipulated to insert the horizontal support surface 14 into the table space 40 corresponding to each rail 30. Each of the thumb screws 68 is manipulated to secure the table unit 12 to the horizontal support surface 14. The object 16 is positioned on the platform 18. The platform 18 is selectively positioned in the stored position and the deployed position according to ergonomic requirements with respect to manipulating the object 16. The first panel 50 is selectively positioned in the deployed position to support a keyboard or the like. Each of the second panels 66 is selectively positioned in the deployed position to support a computer mouse or the like.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable workstation assembly being configured to be removably coupled to a support surface, said assembly comprising:

a table unit being configured to be removably coupled to a horizontal support surface thereby facilitating said table unit to support an object, said table unit comprising a platform having a top surface, a first lateral edge and a second lateral edge, said top surface of said platform being configured to have the object positioned thereon;

a tray unit being slidably coupled to said table unit wherein a top surface of said tray unit is exposable relative to said table unit such that said tray unit is configured to support an object, said tray unit being positionable between a stored position and a deployed position with respect to said table unit, wherein said tray unit comprises a first panel having the top surface of the tray unit, a bottom surface, a first sidelong edge and a second sidelong edge, said top surface of said first panel being configured to have the object positioned thereon, and a pair of pins, each of said pins being coupled to and extending outwardly from an associated one of said first sidelong edge and said second sidelong edge;

a pair of rails, each of said rails including a leg and a foot, said legs correspondingly extending downwardly from said rails, respectively, said feet being correspondingly spaced from and being substantially coextensive with said rails, respectively, to define a table space between each of said foot and said rail, wherein said table space corresponding to each of said rails is configured to insertably receive the horizontal support surface, said rails being spaced apart from each other, each of said rails having a bottom surface;

a pair of first arms, each of said first arms being hingedly coupled between said first lateral edge of said platform and an associated first one of said rails, said first arms being spaced apart from each other;

a pair of second panels, each of said second panels being hingedly coupled to said first panel, said second panels being correspondingly aligned with said first sidelong edge and said second sidelong edge, respectively, each of said second panels being positioned on said bottom surface of said first panel, each of said second panels being positionable in a stored position having each second panel being positioned beneath said first panel, each of said second panels being positionable in a deployed position having each of said second panels correspondingly extending outwardly from said first sidelong edge and said second sidelong edge, respectively;

a pair of first tracks correspondingly coupled to said rails, respectively;

a second pair of tracks correspondingly coupled to said rails, respectively, wherein said second tracks are oriented transverse with respect to said first tracks; and a pair of thumb screws, said thumb screws correspondingly extending upwardly through said feet of said rails, respectively, wherein each of said thumb screws is configured to be manipulated thereby facilitating each of said thumb screws to compress the horizontal support surface between said first tracks and said thumbscrews.

2. The assembly according to claim 1, further comprising:

said first tracks being correspondingly spaced from said bottom surfaces of said rails, respectively, said first tracks extending away from said legs of said rails, respectively, said pins correspondingly slidably engaging said first tracks, respectively, such that said first panel is slidably coupled to said rails, said first panel being positionable beneath the platform of said table unit when said tray unit is positioned in said stored position, said first panel configured to extend forwardly from said legs corresponding to said rails when said tray unit is positioned in said deployed position.

3. The assembly according to claim 2, further comprising:

said second tracks correspondingly extending along said legs of said rails, respectively, such that said second tracks correspondingly intersect said first tracks, respectively, said pins correspondingly and selectively slidable upwardly and downwardly along said second tracks, respectively, when said tray unit is positioned in said deployed position.

4. The assembly according to claim 1, further comprising:

a pair of second arms, each of said second arms being hingedly coupled between said second lateral edge of said platform and an associated second one of said rails, said second arms being spaced apart from each other, said platform being positionable in a stored position having said platform being positioned between said rails, said platform being positionable in a deployed position having said platform being spaced upwardly from said rails.

5. A portable workstation assembly being configured to be removably coupled to a support surface, said assembly comprising:

a table unit being configured to be removably coupled to a horizontal support surface thereby facilitating said table unit to support an object, said table unit comprising:

a platform having a top surface, a first lateral edge and a second lateral edge, said top surface being configured to have the object positioned thereon, a pair of rails, each of said rails including a leg and a foot, said legs correspondingly extending downwardly from said rails, respectively, said feet being correspondingly spaced from and being substantially coextensive with said rails, respectively, to define a table space between each of said foot and said rail, wherein said table space corresponding to each of said rails is configured to insertably receive the horizontal support surface, said rails being spaced apart from each other, each of said rails having a bottom surface, a pair of first arms, each of said first arms being hingedly coupled between said first lateral edge of said platform and an associated first one of said rails, said first arms being spaced apart from each other, a pair of second arms, each of said second arms being hingedly coupled between said second lateral edge of said platform and an associated second one of said rails, said second arms being spaced apart from each other, said platform being positionable in a stored position having said platform being positioned between said rails, said platform being positionable in a deployed position having said platform being spaced upwardly from said rails; and a tray unit being slidably coupled to said table unit wherein a top surface of said tray unit is exposable relative to said table unit such that said tray unit is configured to support an object, said tray unit being positionable between a stored position and a deployed position with respect to said table unit, said tray unit comprising:

a first panel having the top surface of the tray unit, a bottom surface, a first sidelong edge and a second sidelong edge, said top surface being configured to have the object positioned thereon, a pair of pins, each of said pins being coupled to and extending outwardly from an associated one of said first sidelong edge and said second sidelong edge, a pair of first tracks, said first tracks being correspondingly coupled to said rails, respectively, said first tracks being correspondingly spaced from said bottom surfaces of said rails, respectively, said first tracks extending away from said legs of said rails, respectively, said pins correspondingly slidably engaging said first tracks, respectively, such that said first panel is slidably coupled to said rails, said first panel being positionable beneath said platform when said tray unit is positioned in said stored position, said first panel configured to extend forwardly from said legs corresponding to said rails when said tray is positioned in said deployed position, a pair of second tracks, said second tracks being correspondingly coupled to said rails, respectively, said second tracks correspondingly extending along said legs of said rails, respectively, such that said second tracks correspondingly intersect said first tracks, respectively, said second tracks being oriented transverse with respect to said first tracks, said pins correspondingly and selectively slidable upwardly and downwardly along said second tracks, respectively, when said tray unit is positioned in said deployed position, and a pair of second panels, said second panels being hingedly coupled to said first panel, said second panels being correspondingly aligned with said first sidelong edge and said second sidelong edge, respectively, each of said second panels being positioned on said bottom surface of said first panel, each of said second panels being positionable in a stored position having each second panel being positioned beneath said first panel, each of said second panels being positionable in a deployed position having each of said second panels correspondingly extending outwardly from said first sidelong edge and said second sidelong edge, respectively; and a pair of thumb screws, said thumb screws correspondingly extending upwardly through said feet of said rails, respectively, wherein said thumb screws is configured to be manipulated thereby facilitating said thumb screws to compress the horizontal support surface between said first tracks and said thumbscrews.

* * * * *